United States Patent [19]

Sheehy et al.

[11] 4,350,226

[45] Sep. 21, 1982

[54] ELEVATOR FLOOR STOP LOOK-AHEAD

[75] Inventors: George E. Sheehy, Middletown; Joseph Bittar, Simsbury, both of Conn.

[73] Assignee: Otis Elevator Company, Farmington, Conn.

[21] Appl. No.: 267,281

[22] Filed: May 27, 1981

[51] Int. Cl.[3] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 3,570,630 | 3/1971 | Voigt et al. | 187/29 |
| 3,589,474 | 6/1971 | Waure | 187/29 |
| 3,743,055 | 7/1973 | Hoelscher et al. | 187/29 |
| 3,887,039 | 6/1975 | Boniek | 187/29 |
| 4,039,049 | 8/1977 | Yoneda et al. | 187/29 |

*Primary Examiner*—J. V. Truhe

*Assistant Examiner*—W. E. Duncanson, Jr.

*Attorney, Agent, or Firm*—M. P. Williams

[57] ABSTRACT

A group controller (17, FIG. 1) for an elevator system servicing a plurality of cars (3, 4) provides next higher demand signals (21, 23, FIG. 4) in addition to higher and lower demand signals (13, 18, FIG. 4), and provides next hall stop commands (8, 11, FIG. 3) in addition to down hall stop and up hall stop commands (11, 17, FIG. 2). The car controller (15, 16, FIG. 1) of each car will determine when its actual committable floor is equal to a floor ahead of the last committable floor it communicated to the group controller (2, FIG. 5) so as to utilize the next demand and next hall stop commands (3–6, FIG. 5) when it actually has advanced beyond the last committable floor for which the group controller has processed command signals for the car, whereby delays in communicating and processing signals between car controllers and a related group controller cannot result in loss of proper group demand and stop commands to the car controller.

2 Claims, 6 Drawing Figures

ELEVATOR FLOOR STOP LOOK-AHEAD

DESCRIPTION

Technical Field

This invention relates to elevators, and more particularly to improvements in provision of group controller commands to elevators that cause elevators to continue to move or to stop.

Background Art

In most modern elevator systems which have a plurality of elevators serving common floor landings, a group controller allocates the cars to perform service in a manner to distribute the service among the demand being made on the entire group of elevators. One of the functions which the group controller may perform with respect to each elevator is allocation of hall calls to selected elevators, or designation of elevators to act in a collective fashion within a particular zone of the building. In either case, whether cars be allocated to calls or calls allocated to cars, the elevator is caused to advance in a given direction in response to what is referred to as demand. Demand may be in response to hall calls, to the need to move an unused elevator into an empty zone of the building so that it can be available to serve future calls more rapidly, or to other factors.

In such systems, group demand is generated by the group controller and forwarded to the car controller of the elevator to cause the elevator to continue to advance in a given direction until the elevator has a committable floor position (that is, the next floor at which it could stop if it started to descend right now) which coincides with a need to stop (either to park the elevator or to service a call assigned to it). The group controller also generates hall stops whenever the committable floor of an elevator is indicated as being coincident with a hall call assigned to the elevator (either specifically assigned to the elevator or within the zone to which the elevator has been assigned).

The elevator control signal processing required for the group controller to exercise authority over the advancement to and stopping at floor stops by each of the elevators may either be dedicated hardware, which can be analog or digital in nature, or may be performed by a computer which is suitably interfaced and programmed to process the necessary signals to achieve the desired results. The more signal processing hardware which is used, the faster the processing of the signals can be achieved. This is true when comparing large computers with small computers, and it is also true when considering dedicated analog or digital hardware that is duplicated for each elevator in contrast with hardware which is used successively for different elevators. Similarly, if every status indication relating to each elevator is communicated to and from a group controller by its own separate connection, communications are essentially instantaneous between each of the elevators and the group controller. On the other hand, if multiplexing of signals to or from the group controller by successive elevators in a sequence is employed, there is an inherent delay in communicating any status change from the elevator to the group controller and from the group controller to the elevator. The amount of signal processing involved in order to control a group of elevators in a desired fashion may be relatively small or large. The more sophisticated the type of control involved, the more signal processing is involved, and the more communicating is required. For instance, if hall calls are allocated to individual elevators, and the allocation remains static until the call is answered by the first elevator assigned thereto (or reallocated because the elevator cannot reach the call), then communication between the group controller and the elevator is relatively light. On the other hand, if the allocation of each hall call to a given elevator is continuously updated, in cycle after cycle having time frames on the order of the time it takes for an elevator to traverse a floor at high speed, the potential for responding to constantly changing information and providing constantly changing results requires more communication. The increase in communication, along with increased processing, naturally would provide a greater delay in the time between the furnishing of new information by each elevator and the consequential response furnished to the elevator by the group controller.

It therefore becomes possible, in high speed elevator systems having a sophisticated group controller, for the signal communicating and processing delays to become significant. For instance, each elevator keeps track of the position of its own car. It determines its own committable floor (the next floor that the car could stop at if it began descending immediately). In order to generate stop-related commands (further demand to reach a desired stop or stop commands to achieve stop at a desired landing), each elevator communicates its current committable floor to the group controller, and the group controller determines whether, at that committable floor, the elevator has either further demand or a need to stop. If by the time it sends the answer back to the elevator, the elevator has advanced one floor, the information is too late and a stop can be missed or required further demand lost.

DISCLOSURE OF INVENTION

Objects of the invention include provision of improvements in group controller commands provided to a plurality of elevators.

According to the present invention, in response to a given committable floor identified by each elevator to a group controller, the group controller determines demand and stop conditions for that committable floor and the next floor beyond that in the direction of advancement of the elevator, the elevator responding either to the commands relating to its initial committable floor or relating to the next floor beyond that (the look-ahead floor) in dependence upon whether its committable floor has advanced or not in the meantime.

The invention provides an extremely simple manner of allowing signal communication and processing delays between the elevator and the group controller, which may be as great as the time it takes for an elevator to pass by a nonstop floor, without losing any information necessary to cause it to advance and stop in a manner to reach all of the stops which the group controller wants it to reach. By causing the group controller to provide demand and stop commands with respect to the committable floor indicated by the elevator and the floor next subsequent thereto in the advancement direction of the elevator, the elevator can simply compare its current committable floor with the one identified as being subsequent thereto by the group controller, and either use the regular demand and stop signals or the look-ahead demand and stop signals provided thereto by the group controller as the case may be.

The invention may be implemented with digital, analog or computerized signal processing, utilizing only apparatus and techniques which are well within the skill of the art in the light of the specific teachings relating thereto which follow hereinafter. The foregoing and other objects, features and advantages of the present invention will become more apparent in the light of the following detailed description of exemplary embodiments thereof, as illustrated in the accompanying drawings.

BEST MODE FOR CARRYING OUT THE INVENTION

Figure 1:
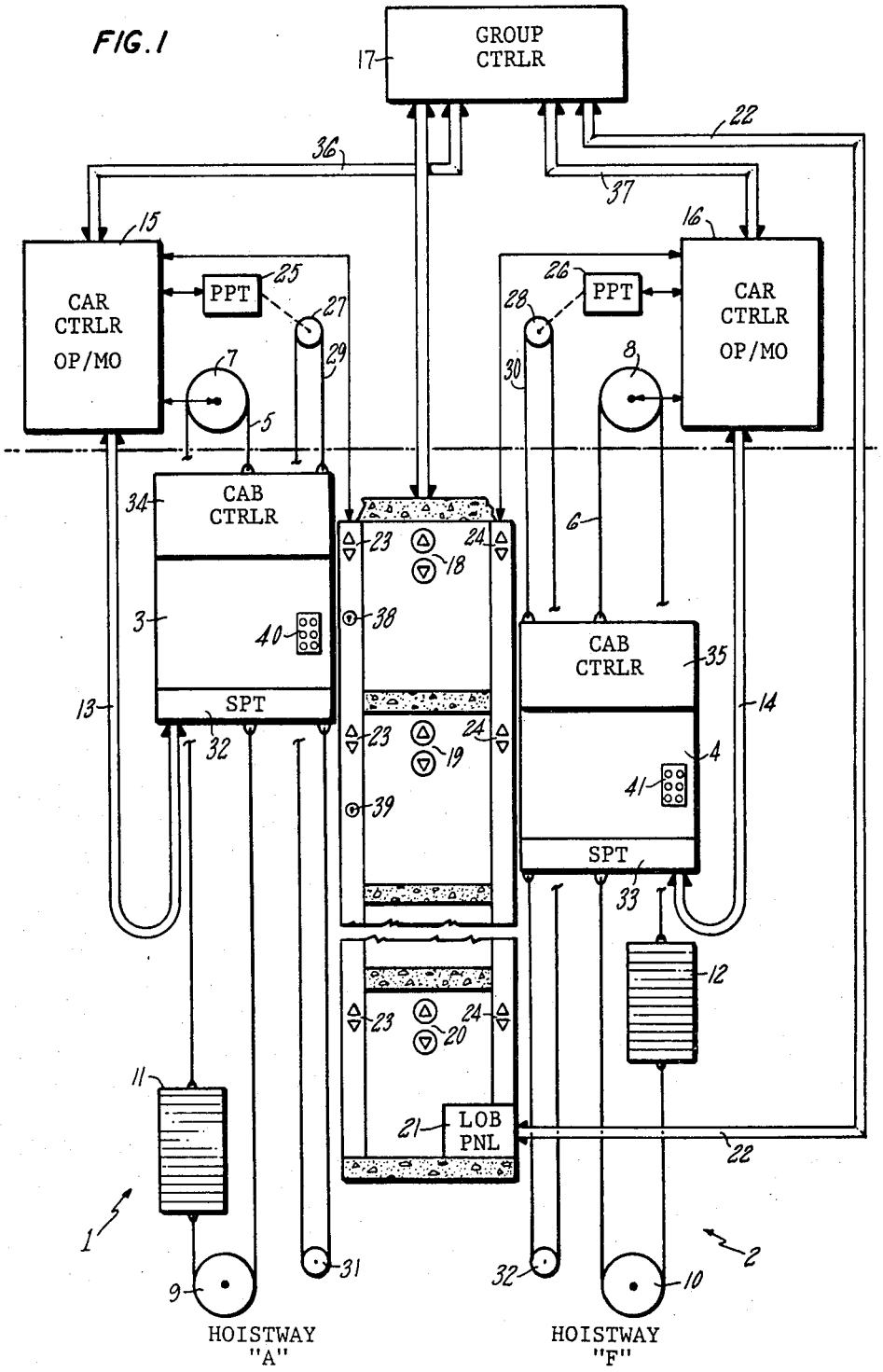
FIG. 1 is a simplified schematic block diagram, partially broken away, of a plural elevator system having a group controller, in which the present invention may be practiced.

A simplified description of a multi-car elevator system, of the type in which the present invention may be practiced, is illustrated in FIG. 1. Therein, a plurality of hoistways, HOISTWAY "A" 1 and HOISTWAY "F" 2 are illustrated, the remainder are not shown for simplicity. In each hoistway, an elevator car or cab 3, 4 is guided for vertical movement on rails (not shown). Each car is suspended on a rope 5, 6 which usually comprises a plurality of steel cables, that is driven in either direction or held in a fixed position by a drive sheave/motor/brake assembly 7, 8, and guided by an idler or return sheave 9, 10 in the well of the hoistway. The rope 5, 6 normally also carries a counterweight 11, 12 which is typically equal to approximately the weight of the cab when it is carrying half of its permissible load.

Each cab 3, 4 is connected by a traveling cable 13, 14 to a corresponding car controller 15, 16 which is located in a machine room at the head of the hoistways. The car controllers 15, 16 provide operation and motion control to the cabs, as is known in the art. In the case of multi-car elevator systems, it has long been common to provide a group controller 17 which receives up and down hall calls registered on hall call buttons 18–20 on the floors of the buildings, allocates those calls to the various cars for response, and distributes cars among the floors of the building, in accordance with any one of several various modes of group operation. Modes of group operation may be controlled in part by a lobby panel 21 which is normally connected by suitable building wiring 22 to the group controller in multi-car elevator systems.

The car controllers 15, 16 also control certain hoistway functions which relate to the corresponding car, such as the lighting of up and down response lanterns 23, 24, there being one such set of lanterns 23 assigned to each car 3, and similar sets of lanterns 24 for each other car 4, designating the hoistway door where service in response to a hall call will be provided for the respective up and down directions.

The foregoing is a description of an elevator system in general, and, as far as the description goes thus far, is equally descriptive of elevator systems known to the prior art, and elevator systems incorporating the teachings of the present invention.

Although not required in the practice of the present invention, the elevator system in which the invention is utilized may derive the position of the car within the hoistway by means of a primary position transducer (PPT) 25, 26 which may comprise a quasiabsolute, incremental encoder and counting and directional interface circuitry of the type described in a commonly owned copending U.S. patent application of Marvin Masel et al, Ser. No. 228,868, filed Jan. 27, 1981 ( a continuation of Ser. No. 927,242, filed on July 21, 1978, now abandoned, which is a continuation of Ser. No. 641,798, filed Dec. 18, 1975, now abandoned), entitled HIGH RESOLUTION AND WIDE RANGE SHAFT POSITION TRANSDUCER SYSTEMS. Such transducer is driven by a suitable sprocket 27, 28 in response to a steel tape 29, 30 which is connected at both its ends to the cab and passes over an idler sprocket 31, 32 in the hoistway well. Similarly, although not required in an elevator system to practice the present invention, detailed positional information at each floor, for more door control and for verification of floor position information derived by the PPT 25, 26, may employ a secondary position transducer (SPT) 32, 33 of the type disclosed and claimed in a commonly owned copending U.S. application of Robert Fairbrother filed on Sept. 21, 1981 (a continuation of Ser. No. 093,475, filed on Nov. 13, 1979, by Fairbrother). Or, if desired, the elevator system in which the present invention is practiced may employ inner door zone and outer door zone hoistway switches of the type known in the art.

The foregoing description of FIG. 1 is intended to be very general in nature, and to encompass, although not shown, other system aspects such as shaftway safety switches and the like, which have not been shown herein for simplicity, since they are known in the art and not a part of the invention herein.

All of the functions of the cab itself may be directed, or communicated with, by means of a cab controller 34, 35 which may provide serial, time-multiplexed communications with the car controller as well as direct, hardwire communications with the car controller by means of the traveling cables 13, 14. The cab controller, for instance, will monitor the car call buttons, door open and door close buttons, and other buttons and switches within the car; it will control the lighting of buttons to indicate car calls, and will provide control over the floor indicator inside the car which designates the approaching floor.

The makeup of microcomputer systems, such as may be used in the implementation of the car controllers 15, 16, a group controller 17, and the cab controllers 33, 34, can be selected from readily available components or families thereof, in accordance with known technology as described in various commercial and technical publications. These include "An Introduction to Microcomputers, Volume II, Some Real Products" published in 1977 by Adam Osborne and Associates, Inc., Berkeley, Calif., U.S.A., and available from Sydex, Paris, France; Arrow International, Tokyo, Japan, L. A. Varah Ltd., Vancouver, Canada, and Taiwan Foreign Language Book Publishers Council, Taipei, Taiwan. And, "Digital Microcomputer Handbook", 1977–1978 Second Edition, published by Digital Equipment Corporation, Maynard, Mass., U.S.A. And, Simpson, W. E., Luecke, G., Cannon, D. L., and Clemens, D. H., "9900 Family Systems Design and Data Book", 1978, published by Texas Instruments, Inc., Houston, Tex., U.S.A. (U.S. Library of Congress Catalog No. 78-058005). Similarly, the manner of structuring the software for operation of such computers may take a variety of known forms, employing known principles which are set forth in a variety of publications. One basic fundamental treatise is "The Art of Computer Programming", in seven volumes, by the Addison-Wesley Publishing Company, Inc., Reading, Mass., and Menlo Park, Calif., U.S.A.; London, England; and Don Mills, Ontario, Canada (U.S. Library of Congress Catalog No. 67-26020). A more popular topical publication is "EDN Microprocessor Design Series" published in 1975 by Kahners Publishing Company (Electronic Design News), Boston, Mass., U.S.A. And a useful work is Peatman, J. B., "Microcomputer-Based Design" published in 1977 by McGraw Hill Book Company (worldwide), U.S. Library of Contress Catalog No. 76-29345.

The software structures for implementing the present invention, and peripheral features which may be disclosed herein, may be organized in a wide variety of fashions. However, utilizing the Texas Instruments' 9900 family, and suitable interface modules for working therewith, an elevator control system of the type illustrated in FIG. 1, with separate controllers for the cabs, the cars, and the group, has been implemented utilizing real time interrupts, in which power-on causes a highest priority interrupt which provides system initialization (above and beyond initiation which may be required in any given function of one of the controllers). And, it has employed an executive program which responds to real time interrupts to perform internal program functions and which responds to communication-initiated interrupts from other controllers in order to process serial communications with the other controllers, through the communication register unit function of the processor. The various routines are called in timed, interleaved fashion, some routines being called more frequently than others, in dependence upon the criticality or need for updating the function performed thereby. Specifically, there is no function relating to elevatoring which is not disclosed herein that is not known and easily implemented by those skilled in the elevator art in the light of the teachings herein, nor is there any processor function not disclosed herein which is incapable of implementations using techniques known to those skilled in the processing arts, in the light of the teachings herein.

The invention herein is not concerned with the character of any digital processing equipment, nor is it concerned with the programming of such processor equipment; the invention is disclosed in terms of an implementation which combines the hardware of an elevator system with suitably-programmed processors to perform elevator functions, which have never before been performed. The invention is not related to performing with microprocessors that which may have in the past been performed with traditional relay/switch circuitry nor with hard wired digital modules; the invention concerns new elevator functions, and the disclosure herein is simply illustrative of the best mode contemplated for carrying out the invention, but the invention may also be carried out with other combinations of hardware and software, or by hardware alone, if desired in any given implementation thereof.

Communication between the cab controllers 34, 35, and the car controllers 15, 16 in FIG. 1 is by means of the well known traveling cable in FIG. 1. However, because of the capability of the cab controllers and the car controllers to provide a serial data link between themselves, it is contemplated that serial, time division multiplexed communication, of the type which has been known in the art, will be used between the car and cab controllers. In such case, the serial communication between the cab controllers 33, 34, and the car controllers 15, 16 may be provided via the communication register unit function of the TMS-9900 microprocessor integrated circuit chip family, or equivalent. However, multiplexing to provide serial communications between the cab controller and the car controller could be provided in accordance with other teachings, known to the prior art, if desired. The controllers 15, 16, 17, may each be based on a microcomputer which may take any one of a number of well-known forms. For instance, they may be built up of selected integrated circuit chips offered by a variety of manufacturers in related series of integrated circuit chips, such as the Texas Instruments 9900 Family. Such a microcomputer may typically include a microprocessor (a central control and arithmetic and logic unit), such as a TMS 9900 with a TIM 9904 clock, random access memory, a read only memory, an interrupt priority and/or decode circuit, and control circuits, such as address/operation decodes and the like. The microcomputer is generally formed by assemblage of chips on a board, with suitable plated or other wiring so as to provide adequate address, data, and control busses, which interconnect the chips with a plurality of input/output (I/O) modules of a suitable variety. The nature of the I/O modules depends on the functions which they are to control. It also depends, in each case, on the types of interfacing circuitry which may be utilized outboard therefrom, in controlling or monitoring the elevator apparatus to which the I/O is connected. For instance, the I/Os which are connected to car call or hall call buttons and lamps and to switches and indicators may simply comprise buffered input and buffered output, multiplexer and demultiplexer, and voltage and/or power conversion and/or isolation so as to be able to sense cars hall or lobby panel button or switch closure and to drive lamps with a suitable power, whether the power is supplied by the I/O or externally.

An I/O module may provide serial communication over current loop lines 13, 14, 36, 37 between the car controllers 15, 16 and the cab controllers 34, 35 and the group controller 17. These communications include commands from the group controller to the cars such as higher and lower demand, stop commands, cancelling hall calls, preventing lobby dispatch, and other commands relating to features, such as express priority service when requested by a switch 38, 39. These communications also include information concerning car calls, normally requested by buttons in panels 40, 41 exchanged between cab and car controllers as well as the group controller. The group controller initiates communication with each of the car controllers in succession, and each communication operation includes receiving response from the car controllers, such as in the well known "handshake" fashion, including car status and operation information such as whether the car is in the group, is advancing up or down, its load status, its position, whether it is under a go command or is running, whether its door is fully opened or closed, and other conditions. And each car controller 15, 16 engages in similar communication with its own cab controller 34, 35. As described hereinbefore, the meanings of the signals which are not otherwise explained hereinafter, the functions of the signals which are not fully explained hereinafter, and the manner of transferring and utilizing the signals, which are not fully described hereinafter, are all within the skill of the elevator and signal processing arts, in the light of the teachings herein. Therefore, detailed description of any specific apparatus or mode of operation thereof to accomplish these ends is unnecessary and not included herein.

Overall program structure of each controller, based upon a data processing system, in which the present invention may be practiced, is reached through a program entry point as a consequence of power up causing the highest priority interrupt, in a usual fashion. Then a start routine is run in which all RAM memory is cleared, all group outputs are set to zero, and building parameters (which tailor the particular system to the building, and may include such things as floor rise and the like) are read and formatted as necessary, utilizing ordinary techniques. Then the program will advance into the repetitive portion thereof, which, in accordance with the embodiment described herein, may be run on the order of every 200 milliseconds. This portion of the program commences with an initialize routine in which all forcing (FORC) and all inhibit or cancel (INH) functions are cleared from memory; field adjustable variables are read and formatted as necessary; the status of each car is read and formatted as necessary; and all the hall calls and car calls are read, and corresponding button lights for sensed calls are lit. Then, all inputs obtained by communication between the cars, the cabs and the group are distributed to the various maps and other stored parameter locations relating thereto.

After initialization a variety of elevatoring functions are performed by various routines on various time bases. Such routines include assigning cars to answer hall calls, parking cars in zones, handling up peak and down peak traffic, and various other functions, including the emergency priority service described hereinafter with respect to the present invention. The car controllers 15, 16 may be implemented in a fashion similar to that described hereinbefore with respect to the group controller 17, having I/O devices suitable for communication with the cab controllers 33, 34 over lines 13, 14 and suitable for interacting with circuitry for controlling the sheave/motor/brake assemblies 7, 8 as well as any related transducers, such as the primary position transducers 26, 26. The car controller has a principal task of controlling the motion of the cab, and at times controlling the cab door. These functions necessarily include other, known subfunctions such as recognizing car calls, and responding to car calls or floor calls assigned by the group (or otherwise) in conjunction with the position of the cab to cause the cab to open and close its doors at appropriate times. Since these functions, and the communications between the various controllers to effect them, are, except as provided hereinafter with respect to the present invention, generally known and within the skill of the art, no particular aspect of them being involved herein except as provided hereinafter, further discussion thereof is not otherwise provided herein.

Figure 2:
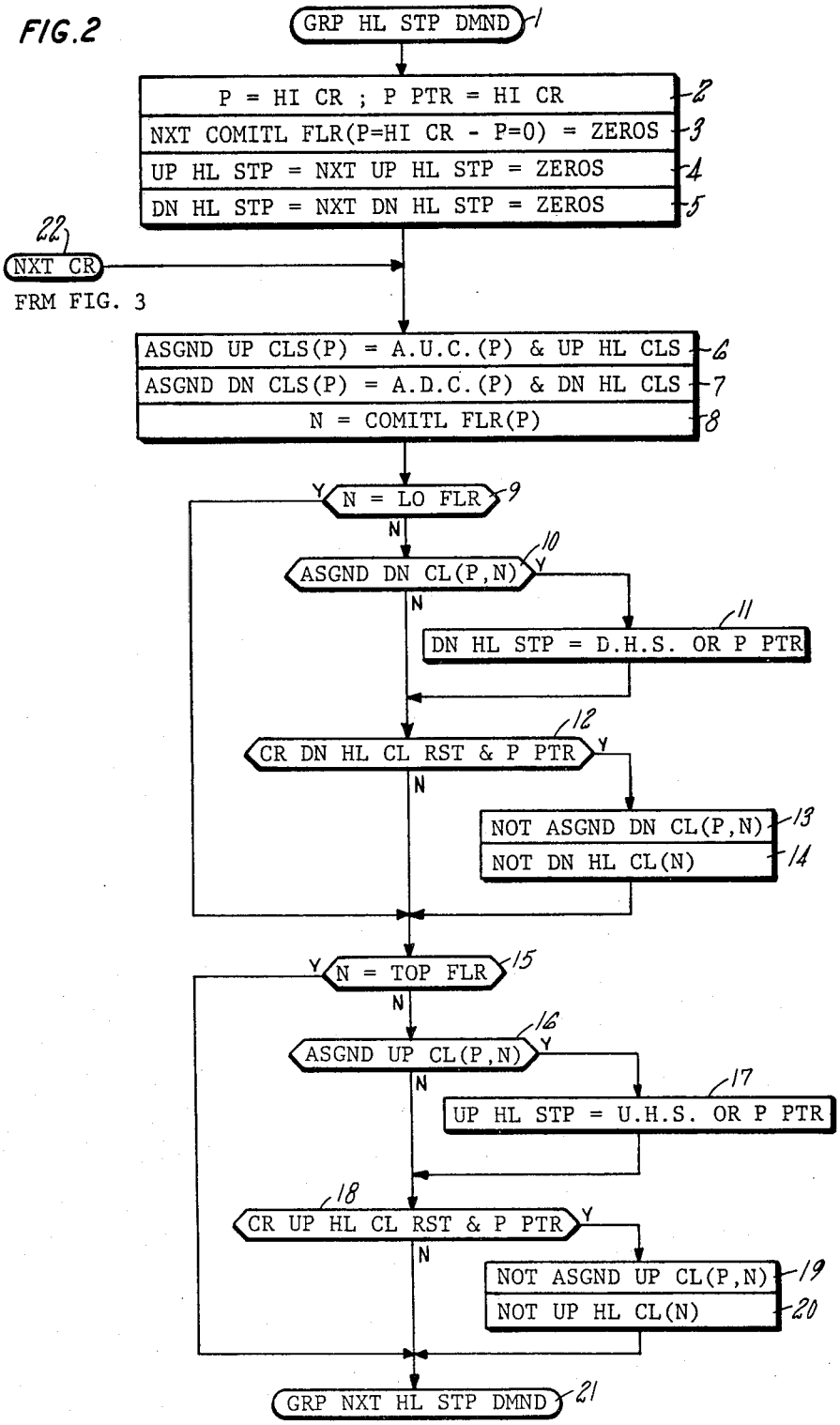
FIGS. 2–4 are simplified logic flowcharts illustrative of programs which may be used in a computer-based group controller to provide both normal and look-ahead demand and stop commands in accordance with the invention.

In FIG. 2, a subroutine for establishing and for canceling group hall stop demands for the various cars is reached through an entry point 1. A pair of steps 2 sets a P number and a P pointer (one bit in a word having a bit for each car in the group, the designated car being a ONE and the rest ZEROS, or vice versa) to indicate the highest numbered car in the group. Then a plurality of steps 3–5 reset, to all zeros, a next committable floor map for each of the cars and the up hall stop, down hall stop, next up hall stop and next down hall stop pointers. Then, in step 6, the map of assigned up calls for car P is ANDed with a map of up hall calls so that any calls which are no longer outstanding (no longer in the map of up hall calls) are removed from the map of up calls assigned to car P. In step 7, the assigned down calls map for cap P is similarly updated by ANDing with the map of down hall calls for the group. A step 8 sets a floor number, N, to be equal to the committable floor of the selected car. Then a test 9 determines if this is the lowest floor in the building, or not. If not, a test 10 determines if there is an assigned down call for car P at floor N. If there is, a step 11 updates a down hall stop map by ORing it with the P pointer indicating that car P has a down hall stop at its committable floor. Then, a test 12 determines if the selected car is among those having a car down hall call reset by ANDing it with the P pointer. If it does, an affirmative result of test 12 causes a step 13 to reset an assigned down call for car P at floor N, which may be accomplished by ANDing the map of assigned down calls for car P with the complement of a floor pointer derived from the floor number, N. And the down hall call for floor N is similarly reset in a step 14. But if test 9 had indicated that N was the lowest floor, there could be no down stops below it, and tests and steps 10–14 are bypassed by an affirmative result of test 9.

In FIG. 2, a test 15 determines if the committable floor of the selected car (N, set in step 8) is the top floor of the building. If not, a negative result of test 15 will reach a test 16 which determines if there is an assigned up call for the selected car at its committable floor. If so, a step 17 updates the map of up hall stops to include the selected car. Next, a test 18 determines if there is a car up hall call reset for the selected car, and if there is, steps 19 and 20 reset the up call for car P at floor N and reset the up hall call for floor N. But if test 15 indicated that the car's committable floor was the top floor, so that the car could not handle any up calls beyond that, then the tests and steps 16–20 are bypassed by an affirmative result of test 15, which causes the routine to advance to a group next hall stop demand routine through a transfer point 21.

Figure 3:
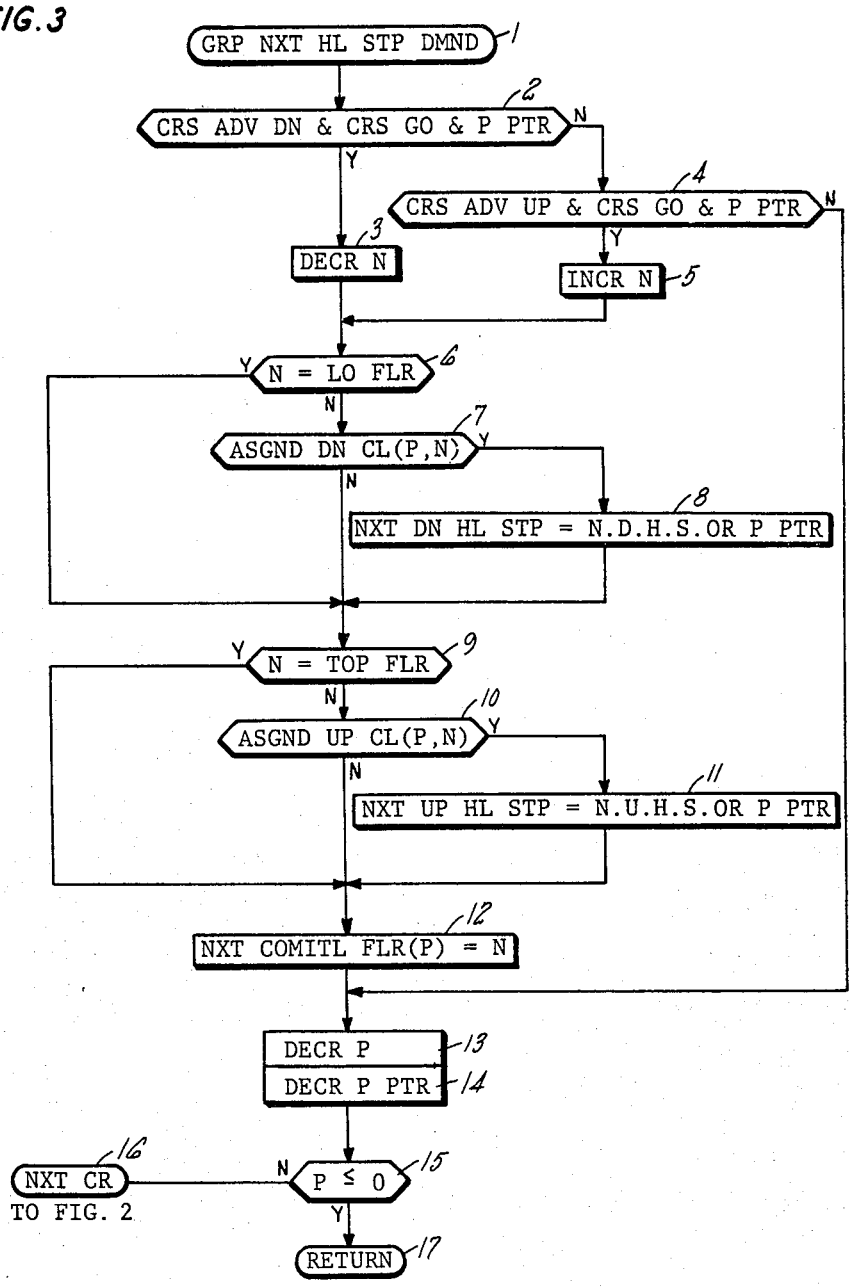

In FIG. 3, the group next hall stop demand subroutine is reached through an entry point 1, and a first test 2 determines, if this car is running down, or not, by ANDing the map of cars advancing down, the map of cars having a go signal and the P pointer. If it is running down, the floor number (N, set equal to the committable floor of this car in step 8 of FIG. 2) is decremented in a step 3. But if test 2 indicates that the car is not running down, then a test 4 determines if the car is running up. If so, a step 5 increments the floor number. Thus either step 3 or 5 will cause the floor number, N, to be equal to the look-ahead floor, that floor which is one floor beyond the committable floor of the car in the direction of its travel when it is running. A test 6 determines if N is equal to the lowest floor in the building. If not, a test 7 determines if there is an assigned down call for car P at floor N. If there is, a step 8 will update a map of next down hall stops (look-ahead stop commands) by ORing it with the P pointer. But if test 6 indicates that the look-ahead floor is the lowest floor in the building, then there cannot be any down calls from that floor, so an affirmative result of test 6 will cause test 7 and step 8 to be bypassed. Then a test 9 determines if the look-ahead floor is the top floor. If not, a test 10 determines if there is an assigned up call for car P at the look-ahead floor. If there is, a step 11 updates the map of next up hall stops by ORing it with the P pointer. But if test 9 is affirmative, there is no point in looking at up calls, so test 10 and step 11 are bypassed. And then a step 12 causes the look-ahead floor for the selected car, the next committable floor for car P, to be set equal to N.

In FIG. 3, if both tests 2 and 4 are negative, the selected car is not running. If it is not running, it does not have a look-ahead floor, so all of the steps and tests 3 and 4–12 are bypassed. And then steps 13 and 14 decrement the P number and the P pointer so as to designate the next lower numbered car in the group and a test 15 determines if all of the cars have been tested. If not, the routine reverts through a transfer point 16 in FIG. 3 and return point 22 in FIG. 2 to step 6 of FIG. 2, so as to assign and cancel up and down hall stops and next hall stops (look-ahead stop commands) for the next car in the group. But when all the cars have been tested through FIGS. 3 and 4, test 15 of FIG. 3 will be affirmative and other portions of the program will be reached through a return point 17.

Figure 4:
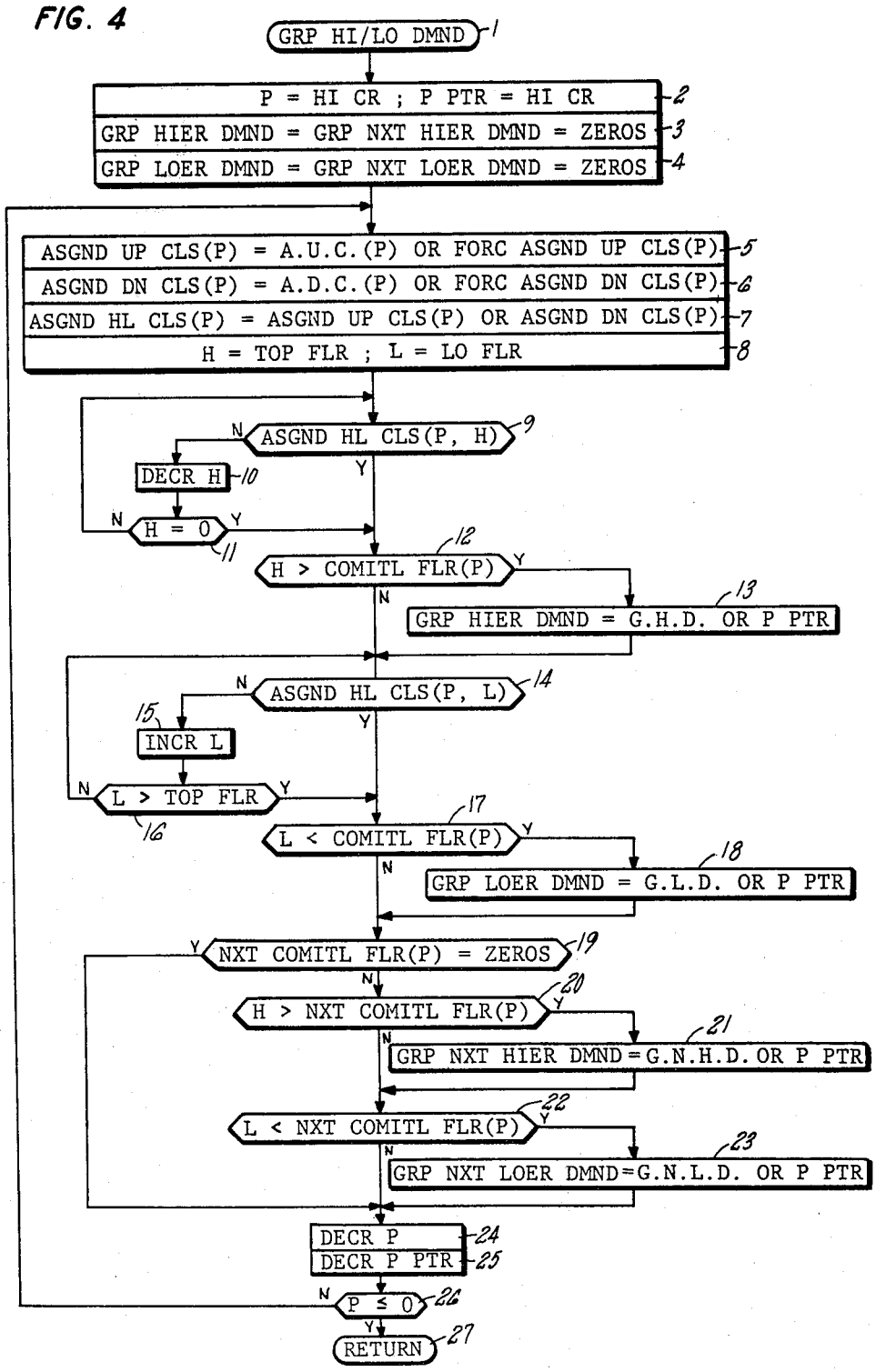

Referring now to FIG. 4, a group higher and lower demand determining routine is reached through an entry point 1, and a first pair of steps 2 set a car-indicating number (P) and a corresponding car-indicating P pointer to both indicate the highest numbered car in the group. Then a step 3 sets the group higher demand map and the group next higher demand map to zeros. Similarly, in steps 4, the group lower demand and group next lower demand maps are set to zeros. As is described more fully hereinafter, these demand maps are maps of cars that have higher demand, next higher demand, lower demand or next lower demand, indicating that there is service in the given direction for the particular car to perform. A map is a word having a ONE for each car having the mapped condition.

In FIG. 4, a step 5 ORs a map of up calls assigned to the selected car, P, with a map of up calls for car P which are being forced. Similarly, a map of assigned down calls for car P is updated in a step 6. In step 7, the up and down calls are merged in a map of assigned hall calls for car P by ORing the updated maps of assigned up calls and assigned down calls for the selected car. In step 8, a number which designates a selected floor, H, is set to equal the top floor, and another number indicating a selected floor, L, is set equal to the floor number of the lowest floor (which may typically be called floor one even though it may be a basement floor). Then, a test 9 determines if there are any assigned hall calls for car P at floor H. This may be achieved by ANDing a map of assigned hall calls for car P with a floor pointer derived from the floor number, H, and testing for an all zeros condition which would be indicative of a negative result of test 9. If there is no assigned hall call (no down call, no up call) assigned to car P at floor H, a negative result of test 9 will lead to a step 10 which decrements H, and a test 11 determines if H has been decremented to zero (all the way through all of the floors in the building). If not, test 9 is repeated for the next lower floor in the building, and so forth. The first time that the particular floor in question (H) has an up call or a down call assigned to car P, an affirmative result of test 9 reaches a test 12 which determines whether this floor is above the committable floor (the next floor which car P could stop at, if it were given a command right now). If car P has a hall call on a floor above its committable position, it has a higher demand. Hall call assignment may be achieved in any suitable way, depending on the nature of the system in which the invention is implemented; one way is disclosed in a commonly owned copending U.S. patent application entitled RELATIVE SYSTEM RESPONSE ELEVATOR CALL ASSIGNMENTS, Ser. No. 99,790, filed on Dec. 3, 1979 by Bittar. Therefore, an affirmative result of test 12 causes a step 13 to update the map of higher demand for the entire group by ORing it with the P pointer so that now the map of higher demand indicates that car P has higher demand as well as any other cars indicated in the map. Then a similar function is performed beginning at the low floor by a test 14 determining if there is any assigned call for car P at the lowest floor in the building. If not, a negative result of test 14 causes a step 15 to increment the floor number L and a test 16 to determine if it has been incremented sufficiently to be greater than the highest floor in the building. If not, test 14 is repeated for the next higher floor in the building, and so forth. When the first floor (L) having an assigned call is reached in the process of incrementing the L number, an affirmative result of test 14 causes a test 17 to determine if L is below the committable floor of car P. If it is, car P has lower demand. A step 18 therefore updates the map of cars in the group having lower demand by ORing it with the P pointer.

In FIG. 4, a test 19 determines if the car has a next committable floor. As described with respect to FIG. 3, the car normally will have a next committable position (one beyond its present committable floor) except when it is not running. If the selected car, P, has a next committable floor, a negative result of test 19 causes a test 20 to determine if the present floor (H) is higher than the next committable floor for car P (as set in step 12 of FIG. 4). If it is, that means that the car has demand at least to the floor beyond its committable floor so that a step 21 updates the group map of cars having next higher demand (look-ahead demand) by ORing it with the P pointer. Similarly, a test 22 and a step 23 will cause the map of cars in the group having next lower demand to be updated by ORing with the P pointer in the case that the current floor, L, under consideration is lower than the next committable floor for car P. When it does not have a next committable floor, there is no need to determine whether there is next higher demand or next lower demand so that an affirmative result of step 19 (indicating that there is no next committable floor for car P) will cause the program to advance to a point where steps 24 and 25 decrement the P number and P pointer so as to select the next lower numbered car in the sequence of cars within the group, and a test 26 determines if all the cars have been tested or not. A negative result of test 26 causes the program to revert to steps and tests 5–23 as described hereinbefore for the next lower car in the sequence. But when all the cars have been tested, an affirmative result of test 26 causes other parts of the routine to be reached through a return point 27.

Figure 5:
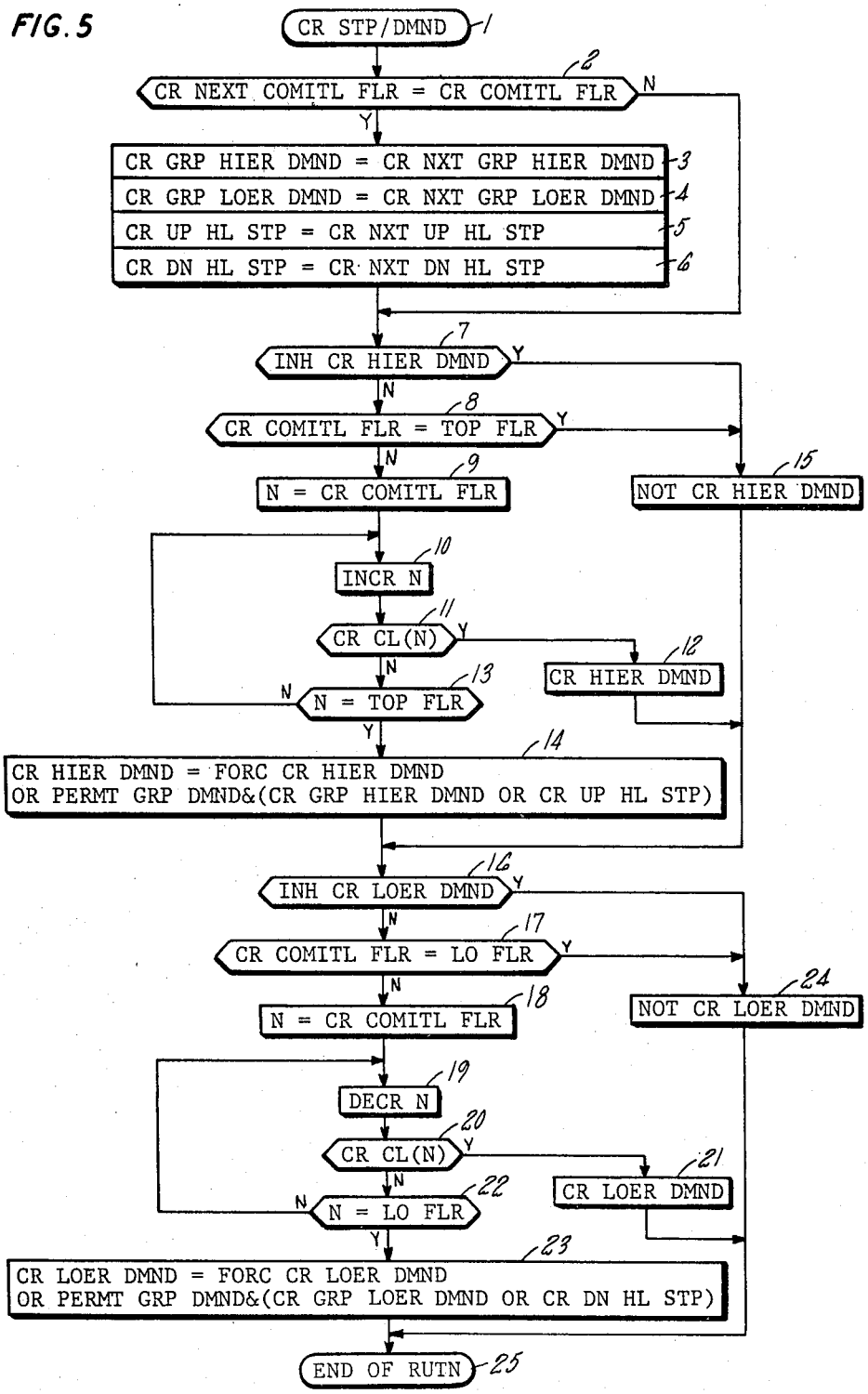
FIGS. 5 and 6 are simplified logic flowcharts illustrative of programs which may be used in a computer-based car controller practicing the present invention.
Figure 6:
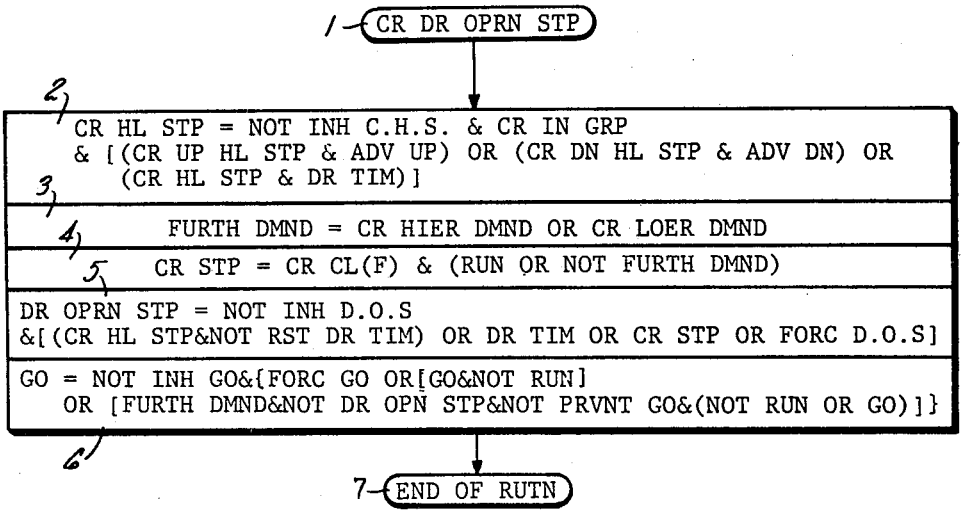

The foregoing is a description of a program for a microprocessor in the group controller 17 (FIG. 1) to accommodate elevator floor stop look-ahead in accordance with the invention. In FIGS. 5 and 6 are shown portions of programs for controlling microprocessors within car controllers 15, 16 (FIG. 1) to interact with the group controller as just described, so as to accommodate look-ahead stop control (demand and stops) in accordance with the invention.

In FIG. 5, a car stop/demand routine is reached through an entry point 1 and a step 2 determines if the actual car committable floor is equal to the car next committable floor, which is the look-ahead floor for the car. The car next committable floor is derived from the map of next committable floor for car P set in step 12 of FIG. 3 within the microprocessor of the group controller 17 (FIG. 1), which is communicated to the car controllers 15, 16 (FIG. 1). In FIG. 5, if the actual committable floor of the car is equal to the look-ahead floor which has been processed for the car in the group controller as described in FIGS. 2–4, an affirmative result of test 2 will reach a step 3 where the car group higher demand is set equal to the car next group higher demand and a step 4 will set the car group lower demand equal to the car next group lower demand. The car next group higher demand is derived from the group next higher demand map established in step 21 of FIG. 4, and the car next group lower demand is derived from the map of group next lower demand set in step 23 of FIG. 4. Then a step 5 in FIG. 5 sets the car up hall stop equal to the car next up hall stop and a step 6 sets the car down hall stop equal to the car next down hall stop. The car next up hall stop is derived from the next up hall stop map set in step 11 of FIG. 3, and the car next down hall stop is derived from the next down hall stop map set in step 8 of FIG. 3. But if the actual committable floor of the car is not the look-ahead floor, a negative result of test 2 causes steps 3–6 to be bypassed.

In FIG. 5, a test 7 determines if higher demand is inhibited for this car. This simply allows tailoring operation, if desired, to suit special cases. Test 7 may be eliminated in the general case. If higher demand is not inhibited, a negative result of test 7 will reach a test 8 which determines if the car committable floor is the top floor of the building. If not, a negative result of test 8 reaches a step 9 in which a floor number, N, is set equal to the committable floor of the car. Then tests are made to determine if there are any car calls (calls established within the car by passengers therein) ahead of the car. In the present case, it is assumed that no car calls can be registered behind the car, which may be established by signal processing within the car controllers 15, 16 (FIG. 1) as is set forth in a commonly owned copending U.S. patent application entitled PREVENTING ELEVATOR CAR CALLS BEHIND CAR, Ser. No. 234,078, filed on Feb. 13, 1981 by Bittar.

In FIG. 5, testing for car calls ahead of the car is commenced by incrementing the floor number in a step 10 and then determining if there is a car call at the designated floor in a test 11. If there is a car call for the floor, a car higher demand status is set by a step 12, and testing of further floors is eliminated since any further reasons for higher demand would be redundant. But if there is no car call for the floor immediately ahead of the car, a negative result of test 11 will cause a test 13 to determine if the top floor has been reached. If not, a negative result of test 13 causes step 10 to again increment the floor number and test 11 to again test for a car call at that floor. Eventually, a floor may be reached where there is a car call causing higher demand to be set in step 12, or all of the floors ahead of the car will be tested reaching an affirmative result of test 13 without establishing higher demand for the car. If all of the floors ahead of the car are checked for car calls and there are none, eventually an affirmative result of test 13 will cause a step 14 to attempt to establish higher demand for the car in an alternative fashion based upon group inputs. Thus, in step 14 the car higher demand can be established if the force car higher demand is present, which may be the case for special tailoring; or the force function of step 14 may be eliminated if not used. Or, car higher demand can be established if the permit group demand status is present, indicating that the car is not on independent service, together with either a car group higher demand (derived from the group higher demand map set in step 13 of FIG. 4, or from the group next higher demand map set in step 21 of FIG. 4 together with the transfer effected in step 3 of FIG. 5) or a car up hall stop (derived from the map established in step 17 of FIG. 2). That is, when group demand is permitted, the car will continue to have demand established by the group, or during the slowdown following a hall stop command, until the car resets the call in step 13 of FIG. 2.

In FIG. 5, if test 7 indicates that higher demand is inhibited or test 8 indicates that the car is committed to the top floor, there can be no higher demand so that a step 15 will reset car higher demand. Then the process set forth in tests and steps 7–15 is repeated with respect to lower demand. A test 16 determines if lower demand is inhibited, and if not, a test 17 determines if the car is at the lowest floor. If not, the floor number, N, is set equal to the committable floor of the car in a step 18. Then the floor number is decremented in a step 19 to represent the first floor ahead of the committable floor of the car, and that floor is tested to determine if there is a car call for this car at that floor in a test 20. If there is, a step 21 sets the car lower demand. But if not, a negative result of test 20 causes a test 22 to determine if all of the floors have been polled to the lowest floor. If not, the floor number is again decremented in step 19 and the floor is tested for a car call in test 20. If all of the floors ahead of the car in the down direction are tested without there being any car calls, an affirmative result of test 22 causes a step 23 to attempt to set lower demand in response to group control, in a fashion fully analogous to that described with respect to step 14 hereinbefore. If either test 16 or 17 is affirmative, there can be no lower demand so a step 24 resets car lower demand. And then other parts of the program may be reached through an end of routine point 25.

In FIG. 6, a routine which controls car door operation stops (frequently referred to as passenger transfer stops) is reached through an entry point 1. This forms no part of the present invention, but is merely illustrative of the environment thereof and usage of stop and demand signals, which may be provided by the look-ahead features of the invention. A step 2 will set a car hall stop provided that car hall stops are not inhibited and the car is in the group and other conditions are met. The other conditions may be either of three combinations. The first condition is that there is a car up hall stop and the car is advancing up. The second condition is that there is a car down hall stop and the car is advancing down. The third condition is that there is already established a car hall stop and the car door operation is not completed as indicated by a door time status flag. The door time status flag is set in response to a floor stop resulting from answering a floor call or a car call when the car does not have a go command or following a door open request until the door is fully closed and door time has not been terminated by an excessive interval, or some countermanding inhibit such as may be used to modify standard operation, or may be eliminated when not used.

In FIG. 6, a step 3 sets further demand to be equal to either higher demand or lower demand, and a step 4 sets a car stop indicator if there is a car call at the committable floor of the car (designated "F" in FIG. 6) and either the car is in a run condition or there is no further demand for the car. The condition of no further demand prevents a car call from holding the car at a floor unless it has no further demand.

In FIG. 6, a step 5 establishes a door operation stop (a stop for passenger transfer) in response to a plurality of different conditions. First of all, door operation stop must be not inhibited by either conditions in the group or conditions in the car, for any special modifications; but the inhibit criteria can be eliminated if desired. If not inhibited, door operation stop can be established by any of four conditions. The first of these is that car hall stop has been established as set forth in step 2 of FIG. 6, and door time has not yet been reset (meaning the door operation is not complete). The second of these is that the door time condition is set as described with respect to step 2 of FIG. 6 hereinbefore. The third of these is that a car stop has been indicated as established in step 4 of FIG. 6, and the fourth of these is the forcing of a door operation stop, such as by any special operation, if desired. In a step 6, the go condition can be established provided it is not inhibited and one of several other conditions occur. The first of these is a forcing of go, such as may occur for special operation, or eliminated, as desired. The second of these is when go has been established but the car has not yet established a run condition so to preserve go until it runs. The third of these conditions is that there is concurrently further demand (as set in step 3 of FIG. 6) without a door operation stop (which was not set in step 5 of FIG. 6) and go is not prevented, if desired for special modification, and either the go command has already been established or the elevator is not in running condition yet. Thus when go is not inhibited, if it is forced, or if it has previously been there but the run status hasn't commenced, or whenever go has previously been set or whenever the elevator is not running and there is further demand no door operation stop and go is not prevented, the go signal will be established or maintained. Then, other parts of the program are reverted to through an end of routine point 7.

The gist of the invention herein relates to determining not only group higher demand and group lower demand (as in steps and tests 9–18 of FIG. 2) but also determining higher and lower demand for a look-ahead floor (the floor designated herein as next committable floor, which is one floor beyond the committable floor of the car) as set forth in tests and steps 19–27 in FIG. 4. Also, the provision of not only the down hall stops and up hall stops as set forth in tests and steps 9–20 of FIG. 2, but also of next down hall stops and next up hall stops as set forth in tests and steps 6–11 of FIG. 3. Further, providing an indication of the next committable floor in step 12 of FIG. 3 which indicates to the car the look-ahead floor for which the next higher and lower demand and next down and up hall stops have been generated, together with testing to see if the actual committable floor of the car has advanced one floor since the last communication from the group as set forth in test 2 of FIG. 5. Thereafter, all that is required is to transfer the next higher and lower demands and up and down hall stops to those used by the car in steps 3–6 of FIG. 5, and the remaining operation is in accordance with teachings known in the art. Thus the invention very simply provides that the capability of the car controllers 15, 16 (FIG. 1) to respond to the most recently updated group control indications relative to demand and stop even though, due to lag in communications and delays in processing, such commands generated for the indicated committable floor of the car become obsolete by the time they are returned to the car. In other words, when the car indicates its present committable floor to the group, and the group processes the group control signals for that car relative to that committable floor, if by the time those signals return to the car the car has actually passed that commitment and is now committed to the next floor in sequence, the car can automatically respond to the look-ahead commands provided thereto by the group controller. In fact, the car can continuously respond to the next floor commands, running one floor behind the group as it were, during its transverse to a stop. However, each time the car stops, it will naturally become caught up, and the group will be processing to the actual committable floor of the car and the car will be responding to signals generated for that floor. If more than one floor of delay were encountered in the communications and signal processing, the simple procedures of the foregoing embodiment of the present invention would be inadequate since it would be possible to jump the commands for a first next floor altogether in some cases. However, straightforward extension of the teachings herein could identify a "2nd Next Committable Floor", a "3rd Next Committable Floor", etc., and generate look-ahead demand and stop commands therefor.

The invention may be used without look-ahead hall stop control in any system where the mere lack of demand will cause a door operation stop. The lack of "GO" causes the car to stop at the next floor it comes to. In step 5 of FIG. 6, if there is no door open stop command, and GO is present, the lack of further demand will prevent GO from continuing. Thus, lack of demand will cause a stop. In the exemplary embodiment, the door of the car would not open in such case, since only door operation stops (passenger transfer stops) cause the door to open. But in the general case, demand alone can be used for look-ahead stop control.

Similarly, although the invention has been shown and described with respect to an exemplary embodiment thereof, it should be understood by those skilled in the art that the foregoing and various other changes, omissions and additions may be made therein and thereto, without departing from the spirit and the scope of the invention.

We claim:

1. An elevator system having a plurality of elevators, each having a car movable in a respective shaftway between a plurality of floor landings in a building, for servicing said landings in common, comprising:

a plurality of selectively actuable request means, each corresponding to one of said landings, a first group thereof each actuable to provide an up hall call signal indicative of a request for service in the up direction from the related landing and a second group thereof each actuable to provide a down hall call signal indicative of a request for service in the down direction from the related landing;

each of said elevators including motion means for selectively providing motion of the respective car in its shaftway in response to a go signal provided thereto and for providing a position signal indicative of the location of said car in said shaftway;

each of said elevators including car control means responsive to said position signal for providing a committable floor signal indicative of the next one of said landings at which said car could be stopped or is stopped and for providing said go signal to said motion means in response to a further demand signal provided thereto; and group control means for exchanging signals with each of said car control means and responsive to said up hall call signals and said down hall call signals for allocating related requests for service to selected ones of said elevators and providing assigned up call signals and assigned down call signals indicative thereof, and responsive to said committable floor signal provided thereto by each of said elevators and ones of said assigned up call signals and assigned down call signals related to such elevator for providing to the corresponding car control means a further demand signal in each case in which there is an assigned up or down hall call ahead of the committable floor of the related car;

characterized by:

said group control means providing, to each of said car control means, a next committable floor signal indicative of the next floor beyond the floor indicated by the corresponding committable floor signal and for providing to the corresponding car control means a next further demand signal in each case in which there is an assigned up or down hall call ahead of the next committable floor of the car; and each of said car control means being responsive to the committable floor signal provided thereby and the related next committable floor signal provided thereto by said group control means to provide said go signal to the related one of said motion means in response to said further demand signal only in each case in which said committable floor signal is different from said next committable floor signal and in response to the corresponding next further demand signal in each case in which said committable floor signal is identical to said next committable floor signal.

2. An elevator system according to claim 1 characterized by said group control means providing to the corresponding car control means a hall stop signal in each case in which there is an assigned up or down call at the committable floor of the related car and a next hall stop signal in each case in which there is an assigned up or down hall call at the next committable floor of the related car, and each of said car control means ceases to provide said go signal to the related one of said motion means in response to said hall stop signal where said committable floor signal is different from said next committable floor signal or in response to said next hall stop signal where said committable floor signal is identical to said next committable floor signal.

* * * * *